US005797506A

United States Patent [19]

Lehmkuhl et al.

[11] Patent Number: 5,797,506

[45] Date of Patent: Aug. 25, 1998

[54] CLOSURE WITH SEAL OPENING MEMBER

[75] Inventors: Bradley P. Lehmkuhl, Rockford; Mark F. Mettler, Grand Rapids, both of Mich.

[73] Assignee: Amway Corporation, Ada, Mich.

[21] Appl. No.: 790,771

[22] Filed: Jan. 27, 1997

[51] Int. Cl.[6] ..... B65D 41/00

[52] U.S. Cl. ..... 215/228; 215/232; 220/212; 220/278; 222/83

[58] Field of Search ..... 215/228, 295, 215/232, 349; 220/212, 277, 278; 206/222; 222/81, 83

[56] References Cited

U.S. PATENT DOCUMENTS

| | | | |
|---|---|---|---|
| 4,452,842 | 6/1984 | Borges et al. | 215/349 X |
| 4,634,013 | 1/1987 | Bar-Kokhba | 215/228 |
| 4,684,554 | 8/1987 | Ou-Yang | 215/349 X |
| 4,709,822 | 12/1987 | Vataru | 215/228 X |
| 5,090,582 | 2/1992 | Art et al. | 215/228 X |
| 5,197,618 | 3/1993 | Goth | 215/349 X |
| 5,292,025 | 3/1994 | Dubreul | 220/278 |
| 5,414,133 | 5/1995 | Ninomiya et al. | 222/81 X |
| 5,464,122 | 11/1995 | Lifshey | 222/83 |
| 5,505,326 | 4/1996 | Junko | 215/228 X |

FOREIGN PATENT DOCUMENTS

| | | | |
|---|---|---|---|
| 867503 | 11/1978 | Belgium . | |
| 847307 | 9/1960 | United Kingdom | 220/278 |

*Primary Examiner*—Allan N. Shoap
*Assistant Examiner*—Robin A. Hylton
*Attorney, Agent, or Firm*—Warner Norcroross & Judd LLP

[57] ABSTRACT

A closure for sealing a container having an opening covered by a seal. The closure includes a peripheral wall and a nub extending upwardly from the top of the cap. The nub is radiused and includes a rounded peripheral edge. The nub also includes a planar outer surface facing the peripheral wall. The size, location and geometric shape of the nub are selected so that when the closure is inverted, placed over the opening, and rotated 360 degrees or more, the nub will tear the seal only partially away from the container.

16 Claims, 3 Drawing Sheets

CLOSURE WITH SEAL OPENING MEMBER

BACKGROUND OF THE INVENTION

The present invention relates to a container or bottle closure, and more particularly, to a closure with an integral seal opening member.

A wide variety of products are stored in bottles and other containers having a screw-on or snap-on closure that closes the container opening. Often a seal is placed over the container opening to seal the container and/or indicate when the container has been opened (e.g. a tamper evident seal). To gain access to the product, this seal must be opened. To facilitate opening of the seal, a number of closures have been designed with elements that cut, tear or puncture the seal. For example, U.S. Pat. No. 4,709,822 issued Dec. 1, 1987 to Vataru, discloses a threaded cap with a seal cutter extending upwardly from the top of the cap. To open the seal, the cap is removed from the bottle, inverted, and pushed down over the opening so that the cutter penetrates the seal. The upper wall of the cap shepherds the cutter into the correct position. The cap is then rotated causing the cutter to cut the seal from the bottle around its periphery. If the cap is rotated 360 degrees or more, the seal will separate completely from the bottle and fall into the container, potentially contaminating the contents. Also, the cutter includes a sharp edge that poses a risk of injury.

A number of seal opening closures have been developed which will not permit the seal to separate entirely from the bottle. One example is shown in U.S. Pat. No. 5,090,582 issued Feb. 5, 1992 to Art et al. Art discloses a closure that utilizes a ramp to partially separate the seal from the container. The Art closure includes a tearing protrusion that extends upwardly from the top of the closure. When the closure is inverted and pushed down onto the neck of the container, the tearing protrusion penetrates the seal. As the inverted closure is rotated, the tearing protrusion tears the seal from the bottle around its periphery. Also, as the closure is rotated, the ramp rides along the threads on the outside of the bottle neck lifting the closure and consequently tearing the protrusion away from the seal for at least a portion of its rotation. This lifting action prevents the protrusion from tearing the seal entirely away from the container. The Art closure requires a relatively tall upper wall that is capable of shepherding the closure even when the ramp has lifted the closure. The relatively tall upper wall is unsightly and increases the overall height of the closure and bottle combination. Further, if excessive downward pressure is applied to the closure during the seal opening process, the ramp can damage the threads on the outside of the bottle neck.

A somewhat similar closure in shown in U.S. Pat. No. 4,634,013 issued Jan. 6, 1987 to Bar-Kokhba. The Bar-Kokhba closure includes an upper wall and cutting protrusion extending upwardly from the top of the cap. A section of thread extends along the inside of the upper wall. When inverted, placed over the bottle neck, and rotated, this thread meshes with the threads along the outside of the bottle neck. The length of the thread is selected so that the closure will tighten against the container before the cutting protrusion has rotated 360 degrees around the seal. Because the cutting protrusion does not rotate 360 degrees around the seal, the seal remains partially attached to the container. The upper wall of the Bar-Kokhba closure must be relatively tall to permit formation of the required section of thread. As a result, the BarKokhba closure, like the Art closure, is unsightly and increases the overall height of the closure and bottle combination. Also, because the closure is screwed onto the bottle neck when opening the seal, it must be unscrewed after the seal is cut. As a result, the Bar-Kokhba closure is relatively inefficient in use. Further, the cutting protrusion includes a sharp edge that poses a risk of injury.

SUMMARY OF THE INVENTION

The aforementioned problems are overcome by the present invention wherein a closure is provided with a nub that tears the seal only partially away from the container even when the closure is rotated 360 degrees or more. The closure includes a ridge extending upwardly around the periphery of the top wall of the closure. The nub extends upwardly from the top wall and is spaced inwardly from the ridge. The nub is preferably radiused and includes a rounded peripheral edge that tears rather than cuts the seal. Also, the surface of the nub facing the ridge is preferably planar. The dimensions and location of the nub are selected such that when the closure is inverted, placed over the bottle neck, and rotated, the nub will tear the seal only partially away from the container even when rotated more than 360 degrees.

The present invention provides a simple and effective closure that functions to both close the container and remove the seal. The closure operates to only partially separate the seal from the container even when the closure is rotated 360 degrees or more. As a result, the seal will not fall into the container and contaminate the contents. Also, the upper wall and nub are relatively short making the closure aesthetically pleasing. Further, the nub is ideally rounded thereby reducing the risk of injury to the user.

These and other objects, advantages, and features of the invention will be readily understood and appreciated by reference to the detailed description of the preferred embodiment and the drawings.

DETAILED DESCRIPTION OF THE PREFERRED EMBODIMENT

Figure 1:
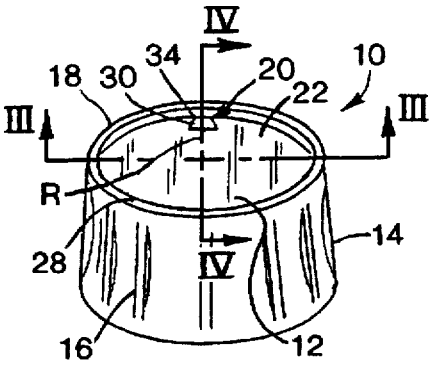
FIG. 1 is a perspective view of a closure according to a preferred embodiment of the present invention.

A closure according to a preferred embodiment of the present invention is illustrated in FIG. 1 and generally designated with reference numeral 10. In the illustrated embodiment, the closure 10 is adapted for use on a bottle 80 of the type conventionally used to contain liquids such as liquid detergent and liquid bleach (See FIG. 2). The bottle 80 includes a neck 82 that defines an opening 84 which permits access to the contents (See FIG. 5). The opening 84 is covered by a conventional foil seal 90. The closure 10 functions to both close the bottle 80 and rupture the seal 90.

To close the bottle, the closure 10 is screwed onto the bottle neck 82 in a conventional manner. To rupture the seal 90, the closure 10 is removed from the bottle neck 82, inverted, forced down onto the seal 90, and rotated. The present invention is well-suited for use with other types of sealed containers, including containers with non-threaded closures such as snap-on closures.

Figure 4:
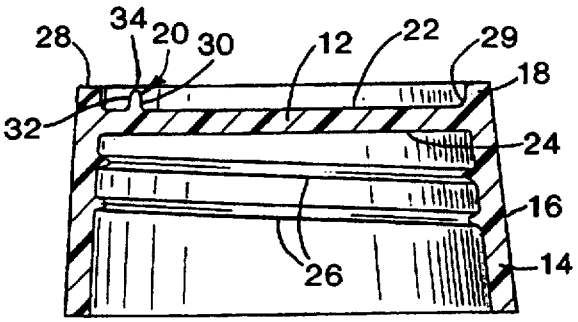
FIG. 4 is a sectional view of the closure taken along line IV—IV in FIG. 1.
Figure 3:
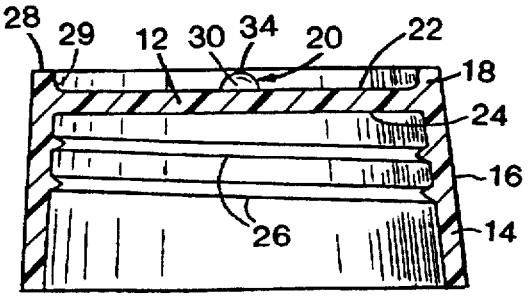
FIG. 3 is a sectional view of the closure taken along line III—III in FIG. 1.
Figure 6:
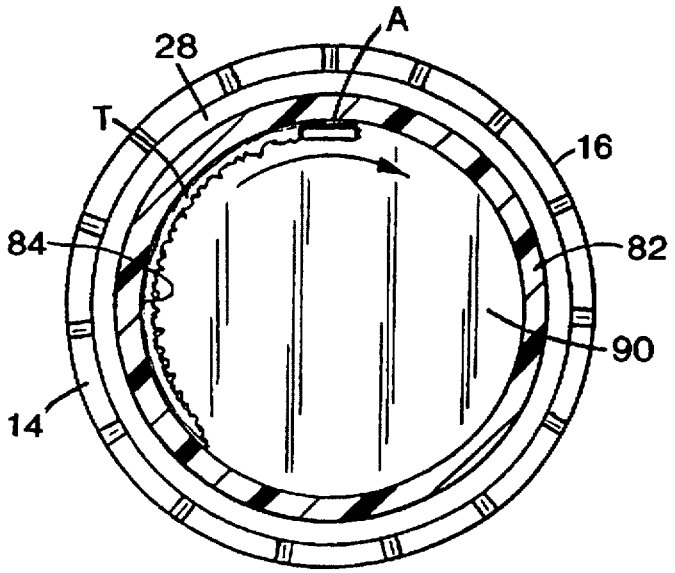
FIG. 6 is a sectional view of the nub penetrating the seal.

The closure 10 includes a top wall 12, a lower peripheral wall 14, an upper peripheral wall 18, and a nub 20. The top wall 12 is generally disc-shaped and includes top and bottom surfaces 22 and 24. The lower peripheral wall 14 extends downwardly from the periphery of the top wall 12 to form a skirt 16 that surrounds a portion of the bottle neck 82 when the closure 10 is installed. Threads 26 are formed along the inside of the skirt 16. The threads 26 are adapted to mate with the bottle threads 86 such that the closure 10 is threadedly installed and removed by rotating the closure 10 with respect to the bottle 80. The outer surface of the skirt 16 can be ribbed or textured in a conventional manner to provide a non-slip gripping surface. The upper peripheral wall 18 extends upwardly from the periphery of the top wall 12 to form a relatively short peripheral ridge 28. A fillet 29 extends around the joint between the inner edge of the ridge 28 and the top wall 12. Referring now to FIGS. 3 and 4, the nub 20 extends upwardly from the top surface 22 of the top wall 12 disposed inwardly from the ridge 28. The nub 20 is preferably radiused to form an arcuate peripheral top edge 34. The peripheral edge 34 is rounded making the nub relatively blunt so that, in use, the nub 20 tears rather than cuts the seal 90. The nub 20 in this preferred embodiment includes parallel inner 30 and outer 32 surfaces that extend perpendicularly to the top wall 12 and to the radius R (shown in FIG. 1) which bisects the nub 20. Because these surfaces are planar, a small area of relief A is provided between the nub 20 and the ridge 28 (See FIG. 6). This area of relief A contributes to the unique ability of the closure 10 to tear the seal only partially away from the container.

Figure 8:
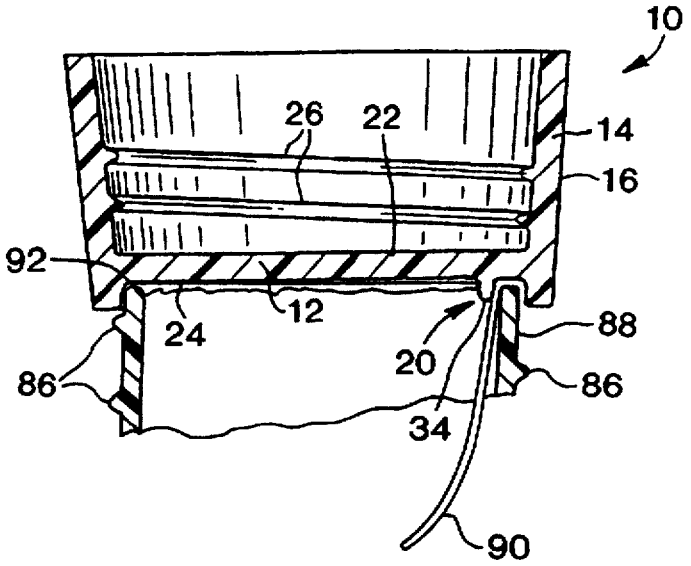
FIG. 8 is a fragmentary sectional view of the closure positioned over the bottle neck showing the seal in the folded position.

The size, location, and geometric shape of the nub are important to proper functioning of the closure 10. These characteristics will vary from application to application depending on the characteristics of the particular seal used to seal the bottle and the various dimensions of the bottle neck 82 and bottle land 92. Because the nub 20 is preferably planar and the ridge 28 is curved, the distance between the nub 20 and ridge 28 varies along the length of the nub 20. In the most preferred embodiment, the face 32 of the nub 20 (at its longitudinal center) is spaced approximately 0.120 inch from the ridge 28 and approximately 0.060 inch from the fillet 29. This provides a distance of just over 0.060 inch between the ridge 28 and opposite ends of the nub 20. This distance is selected based primarily on the width of the bottle land 92 which must fit between the nub 20 and the ridge 28. Further, there must be sufficient space to allow a portion of the seal to fold down between the land 92 and the nub 20 (See FIG. 8). In the most preferred embodiment, the width of the bottle land 92 is approximately 0.060 inch (described in more detail below). A wider bottle land will obviously require increased spacing between the nub 20 and the ridge 28. The height of the nub 10 is approximately 0.080 inch and its peripheral edge is curved at a radius of approximately 0.100 inch. The height of the ridge 28 in this embodiment is approximately 0.095 inch. As a result, the ridge 28 extends only slightly above the nub 20. The ridge 28 and nub 20 cooperatively sandwich about land 92 to guide the closure 10 when it is rotated to tear open the seal 90.

Figure 2:
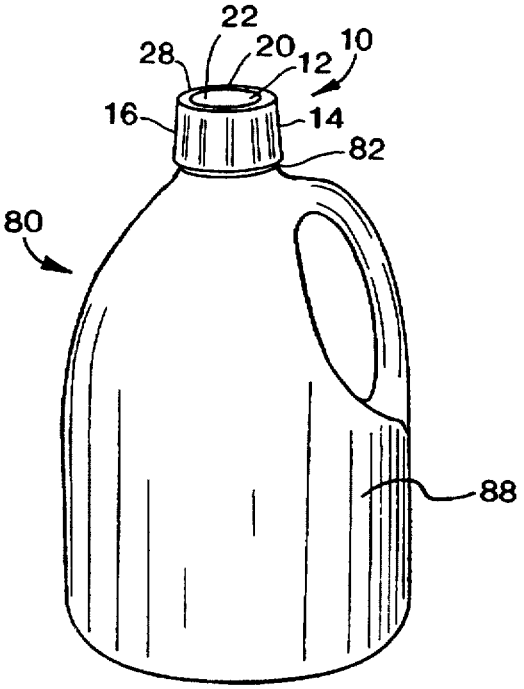
FIG. 2 is a perspective view of a bottle incorporating the closure.
Figure 5:
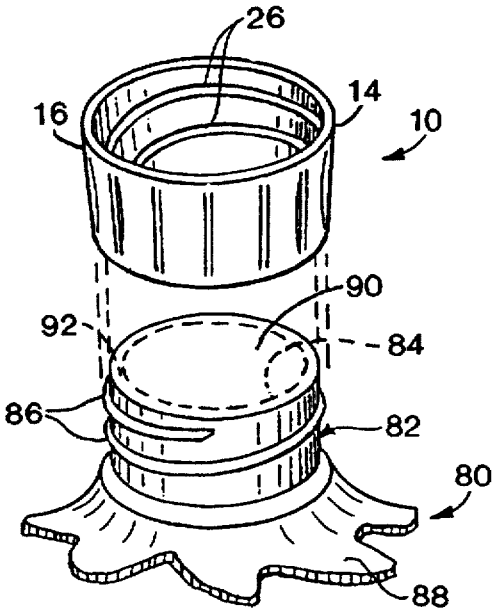
FIG. 5 is a fragmentary perspective view of the closure positioned over the bottle neck.

Referring now to FIGS. 2 and 5, the bottle 80 is generally conventional and includes body portion 88 and neck 82. The neck 82 protrudes from the body portion 88 and is preferably cylindrical. As noted above, the neck 82 defines the opening 84 which permits access to the contents. The neck 82 includes a planar land 92 surrounding the opening 84. In the most preferred embodiment, the bottle land 92 is approximately 0.060 inch wide. The foil seal 90 is taughtly secured to land 92 over the opening 84 in a conventional manner, preferably by induction sealing. Also, threads 86 are formed around the outside surface of the neck 88 to threadedly engage with the closure 10. The size, shape, and orientation of the threads 86 will vary from application to application.

Figure 7:
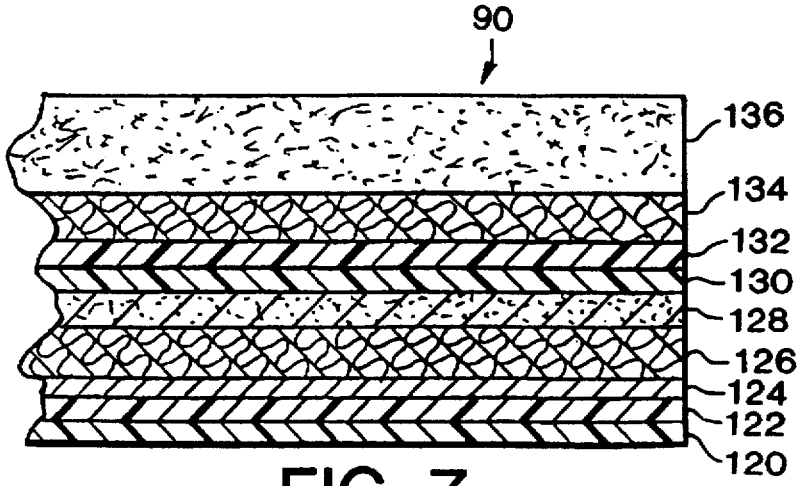
FIG. 7 is an enlarged, fragmentary sectional view of a portion of the seal.

The seal 90 is preferably a conventional foil induction seal. An acceptable foil induction seal is available from Unipak of Auora, Ontario, Canada under the trade name SAFEGUARD 634 induction seal. As shown in FIG. 7, this seal includes, from the bottom up, a 1.5 mil layer of ethylene vinyl acetate 120, a 0.5 mil layer of polyethylene terephthalate 122, a 1.5 mil layer of foil 124, a 3 mil layer of paper 126, a wax layer 128, a 0.5 mil layer of polyethylene terephthalate 130, a 0.1 mil layer of polyvinylidene chloride 132, a 3.5 mil layer of paper 134, and a 0.030 inch layer of pulp 136. The construction of the seal 90 may vary from application to application, however, significant variations may require adjustments in the size, location, and geometry of the nub 20. In any event, the seal 90 must have sufficient ductility to fold or bend without tearing completely from the land 92.

The closure 10 functions to close the bottle 80 in a conventional manner. First, the closure 10 is positioned upright with its skirt 16 fitted over the bottle neck 82. The closure 10 is then rotated clockwise causing the closure threads 26 and bottle threads 86 to mesh and draw the closure down onto neck 82. As the closure 10 is rotated, the bottom surface 24 of the top wall 12 eventually engages the seal 90 attached over the opening 84. Continued rotation of the closure 10 compresses the peripheral edge of the seal 90 between the bottom surface 24 of the top wall 12 and the bottle land 92. In this manner, the closure 10 covers the seal 90 and prevents the contents from spilling from the bottle 80. After the seal 90 has been removed from the opening 84 (as described below), its peripheral edge remains attached around the bottle land 92. This peripheral edge portion functions as a gasket to aid in sealing the bottle 80 when the closure is re-threaded onto the neck 82.

The closure 10 also functions to rupture and tear the seal 90 so that it is easily removed from the bottle 80. To rupture the seal 90, the closure 10 is removed from the bottle 80 in a conventional manner (i.e. by rotating it in a counterclockwise direction). Once the closure 10 is removed from the bottle 80, it is inverted so that the nub 20 is pointed downwardly. The closure 10 is then pushed down onto neck 82 with the ridge 28 encircling the bottle land 92 until the top surface 22 of the top wall 12 firmly engages the seal 90. As the closure 10 is pushed down, the nub 20 punctures the taut seal 90 which acts as a membrane. The nub 20 is provided with a curved, blunt peripheral edge that by virtue of its design attempts to push or fold the seal down rather than cut it. Because the seal 90 is initially held taut by its attachment to the bottle land 92 around its entire periphery, it cannot be folded down by the nub. As a result, the nub 20 punctures the seal 90 as it is pushed down onto neck 82. Once the seal 90 is punctured, the closure 10 is rotated causing the nub 20 to form a continuous tear T through the seal around a majority of the bottle land 92. At this point, the seal 90 is still held taut by its attachment to the bottle land 92 around the majority of its periphery. As a result, the seal 90 cannot fold beneath the nub 20 and rotation of the closure 10 causes the nub 20 to form a tear in the seal 90. As show in FIG. 6, the tear is formed just inside the inner edge of the bottle land 92. Because the nub 20 is radiused, the closure 10 can be rotated in either a clockwise or counterclockwise direction to effect the tear. As the closure 10 is rotated, the tear T progresses around the periphery of the seal 90. As the tear T progresses, the seal 90 is increasingly separated from the land 92 in turn increasingly reducing the tautness of the seal 90. Once the closure 10 is rotated far enough to form a tear around approximately 300 degrees of the seal 90, the nub 20 begins to fold rather than tear the seal 90 due to the loss in tautness in seal 90 (See FIG. 8). This loss of tautness results from the seal 90 being progressively separated from the bottle land 92 by the tear T. As the seal 90 is progressively torn from the bottle land 92, the portion of the seal 90 that remains attached to the bottle land 92 is decreased. For example, when the tear T extends around one-half of the seal's periphery, that half of the seal 90 hangs freely and could be folded up or down by hand while the other half remains taut and resists upward or downward movement. When the tear T extends around approximately 300 degrees of the seal 90, the seal 90 is attached to the bottle land 92 along only approximately 60 degrees of its periphery. At approximately this point, the portion of the seal 90 that remains taut is not sufficient to prevent the seal 90 from being folded down by the nub 20. As a result, the rounded edge of the nub 20 ceases tearing the seal 90 and instead pushes it down causing it to fold against the inside edge of the bottle neck. As a result, the seal 90 remains attached to the bottle land 92 over approximately the last 60 degrees. This prevents the seal 90 from falling into the bottle 80. The opened seal 90 can be removed entirely from the bottle 80 by hand.

The above description is that of a preferred embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A container comprising:

a body;

a neck extending the body, said neck having a land defining a plane and an opening;

a seal tautly secured across said land, covering said opening and lying parallel to said plane, said seal including a layer of foil and a layer of plastic; and a closure having a generally circular top wall with a periphery, a generally semi-circular nub with a blunt peripheral edge extending upwardly from said top wall, and an upper wall extending upwardly around the periphery of said top wall, said top wall, said nub having a substantially planar outer surface facing said upper wall and an axis extending parallel to a radius of said top wall;

said nub defining a tearing means for tearing away from the container only a partial portion of the seal, said nub further defining a means assisting in the downward movement of the seal upon rotation of the closure beyond a predetermined circumferential distance to prevent the seal from being completely separated from said land upon rotation of the closure more than 360 degrees.

2. The container of claim 1 wherein said peripheral edge is rounded.

3. The container of claim 2 wherein said nub includes a height and a radius, said radius being greater than said height.

4. The container of claim 3 wherein said upper wall includes a height, said height of said upper wall being no more than slightly greater than said height of said nub.

5. The container of claim 4 wherein said outer surface of said nub extends perpendicularly to said radius.

6. The container of claim 5 wherein said nub is symmetrical about a line extending perpendicularly from said top at said radius.

7. The container of claim 6 wherein said height of said nub is no greater than approximately 100 thousands of an inch.

8. The container of claim 7 wherein said land includes a width, said nub spaced no more than two times said land width away from said upper wall.

9. A method for opening a container comprising the steps of:

providing a container having a neck defining an opening;

tautly securing a seal to the neck over the opening, said opening and said seal lying in parallel planes;

providing a closure having a generally circular top wall with a periphery, a skirt extending downwardly from the periphery of the top wall, an upper peripheral wall extending upwardly from the periphery of the top wall, and a generally semi-circular nub extending upwardly from the top wall, the nub having a blunt peripheral edge and an axis extending parallel to a radius of the top wall, the nub including a height and being spaced apart from the upper peripheral wall a distance;

orienting the closure such that the nub is pointing toward the seal;

forcing the closure onto the neck such that the nub penetrates the seal and the upper peripheral wall surrounds the neck; and rotating the closure at least 360 degrees, wherein the height and the distance are selected such that when rotated at least 360 degrees the nub initially forms a tear around only a portion of the seal and thereafter folds the seal down along the inside of the bottle neck whereby the seal remains attached to the bottle regardless of how far the closure is rotated.

10. The method of claim 9 wherein the nub includes a rounded peripheral edge.

11. The method of claim 10 wherein the nub height is selected as a function of the seal characteristics such that when the closure is rotated during said rotating step, the nub forms a tear around only a portion of the seal such that the seal remains attached to the bottle regardless of how far the closure is rotated.

12. The method of claim 11 wherein said rotating step includes rotating the closure in either direction.

13. The method of claim 12 wherein the nub has a height of less than 100 thousands of an inch.

14. The method of claim 13 wherein the seal includes a layer of foil and a layer of plastic.

15. The method of claim 14 wherein the nub includes a planar outer surface facing the upper peripheral wall.

16. The method of claim 15 wherein a peripheral portion of the seal remains attached to the neck whereby the peripheral portion aids in sealing the container when the closure is secured on the neck.

* * * * *

UNITED STATES PATENT AND TRADEMARK OFFICE

CERTIFICATE OF CORRECTION

PATENT NO. : 5,797,506

DATED : August 25, 1998

INVENTOR(S) : Bradley P. Lehmkuhl et al

It is certified that error appears in the above-indentified patent and that said Letters Patent is hereby corrected as shown below:

Column 5, Claim 1, Line 43:
after "extending" insert --from--

Column 5, Claim 1, Line 52:
delete second instance of "said top wall,"

Signed and Sealed this

Ninth Day of February, 1999

*Attest:*

*Attesting Officer*

*Acting Commissioner of Patents and Trademarks*